US005178394A

United States Patent [19]

Tanampai

[11] Patent Number: 5,178,394

[45] Date of Patent: Jan. 12, 1993

[54] SHAFT ATTACHABLE GOLF CLUB WEIGHT

[76] Inventor: Niyom Tanampai, 179/3, Soi Kingchan, Chan Road, Tong Wat Don Bangkok, Thailand, 10120

[21] Appl. No.: 797,175

[22] Filed: Nov. 25, 1991

[30] Foreign Application Priority Data

Aug. 19, 1991 [TH] Thailand ..... 014185

[51] Int. Cl.[5] ..... A63B 69/36

[52] U.S. Cl. ..... 273/194 B; 273/163 A

[58] Field of Search ..... 273/186 A, 194 R, 194 A, 273/194 B, 193 R, 193 A, 193 B, 162 R, 183 D, 163 A

[56] References Cited

U.S. PATENT DOCUMENTS 2,986,937 6/1961 Chapman ..... 273/186 A

*Primary Examiner*—George J. Marlo

*Attorney, Agent, or Firm*—Malloy, Downey & Malloy

[57] ABSTRACT

A device to be used in combination with a golf club to couple forces acting thereon when swinging, the device being structured and disposed to be attached to the shaft of the golf club so as to balance the golf club during a swing. The device includes a clamp portion for removably attaching the apparatus to the golf club, a weight portion, whose positioning about the golf club shaft will act as an auxiliary couple to balance the club face, a protruding screw extending from the clamp portion about which the cylindrical weight is positioned, and an O-ring secured about the screw such that the weight is kept from moving during the golf swing.

5 Claims, 1 Drawing Sheet

SHAFT ATTACHABLE GOLF CLUB WEIGHT

BACKGROUND OF THE INVENTION

1. Field of the Invention

This invention relates to a device to couple forces which is adapted to be removably fastened to the shaft of a golf club, thereby providing the user with a means of balancing the club face which will result in a properly oriented stroke attitude when hitting a golf ball.

2. Description of the Prior Art

Golf is a very popular sport enjoyed by many individuals, but it is very difficult to excel at it due to the precision required to produce a consistent and accurate swing. As a result of this, many instructional tapes and swing constraining apparatuses have been designed to conform an individual's swing to the instructor's ideal swing. Unfortunately, what may be a consistent, balanced swing to one individual, may be highly uncomfortable and unproductive for another individual. Further, club designs, primarily those of putters, have been implemented to attempt to maintain the face of the club steady during the swing, but the success of the designs vary for each individual. Accordingly, there is a need for an apparatus or device that can balance the club face, and accordingly any individual's swing or stroke based on objective, individualized, physical principals, rather than the subjective principals of a given instructor or the generalized balancing standards of club manufacturers.

It has been realized that one of the key elements to a consistent and accurate swing is to maintain balance throughout an individual's golf swing. By balance it is meant that the result and force exerted by a golfer in his swing is centralized along the face of the club so as to keep the club head from turning during the swing. By adding a free vector, or force couple, full power and accuracy, as well as consistency, will naturally occur. The Applicant's invention is designed to act as such a force couple which is individualized to the particular user by adjusting the position of a weight means on the apparatus. Accordingly, a golfer can adjust the apparatus until the ideal balanced swing for the individual golfer has been attained.

Applicant's invention removes the subjectivity involved in perfecting a golf swing by using objective, individualized, scientific principals. None of the prior art designed to improve a golf swing utilizes the Applicant's principal as set forth in the claimed device.

SUMMARY OF THE INVENTION

The present invention is directed towards a device to couple forces acting on a club head when swinging a golf club. The device, which is designed to be clamped to the shaft of a golf club, includes a clamp member having a clamp portion and an elongate cylindrical shaft portion, and a generally cylindrical weight means. Protruding from the cylindrical shaft portion of the clamp member, and secured within a threaded cylindrical socket therein, is an elongate screw. Generally half of the screw protrudes from the clamp member, and the screw further includes an O-ring made of rubber or a like high friction material secured about the screw at its protruding distal end. The generally cylindrical weight means includes a concentrically located transverse bore which includes portions having three separate diameters. A proximal portion of the bore within the weight means, is of a diameter slightly larger than the cylindrical shaft portion of the clamp member, such that the weight means may slidably surround the shaft portion. A center portion of the transverse bore of the weight means is of a diameter slightly larger than the diameter of the screw, such that the weight means may slidably move over the screw, but it is also small enough such that the head portion of the screw may not pass therethrough when the weight means is slid. Finally, a distal portion of the transverse bore in the weight means is of a diameter such that it contacts the O-ring positioned on the screw in such a manner that the weight means may slide thereover only when desired.

It should be noted that the device of the present invention can be used in other applications in addition to use with golf clubs. Specifically, the device may be useful in mechanically balancing a moving component in a machine such as when it is necessary to balance a structure moving in a pendulum-like motion.

BRIEF DESCRIPTION OF THE DRAWINGS

For a full understanding of the nature of the present invention, reference should be had to the following detailed description taking in connection with the accompanying drawings in which.

Like referenced numerals refer to like parts throughout the several views of the drawings.

DETAILED DESCRIPTION OF THE PREFERRED EMBODIMENT

As shown in FIGS. 1 through 5, the present invention is directed towards a force couple device, generally indicated as 10.

Figure 1:
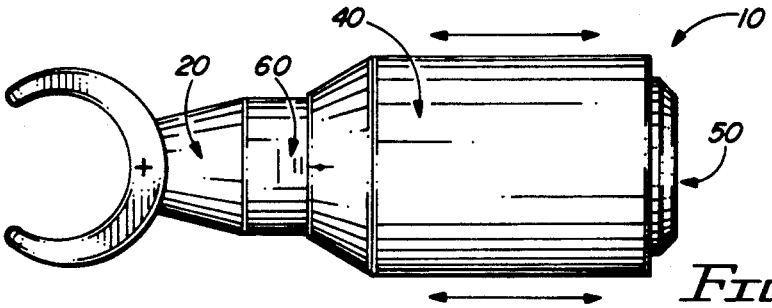
FIG. 1 is a perspective view of the force couple device.

As shown in FIG. 1, the couple device 10 includes primarily a clamp member 20 and weight means 40. The weight means 40 are positioned to slidably move with relation to the clamp member 20, and indicia 60 may be included on the surface of the clamp member 20, such that the positioning of the weight means 40 may be easily observed.

Figure 2:
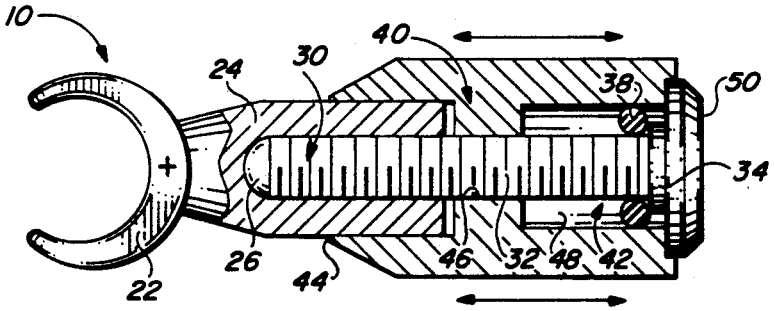
FIG. 2 is a cross-sectional view of the force couple device along line 2—2 of FIG. 3.

Turning to FIG. 2, the clamp member 20, which may be made of a sufficiently elastic, yet rigid, plastic or like material, includes a rounded clamp portion 22 and an elongate cylindrical shaft portion 24. The clamp portion 22 is sized and configured for removable attachment about the shaft of a golf club adjacent the club head. Concentrically positioned within the elongate cylindrical shaft portion 24 of the clamp member 20 is a threaded cylindrical socket 26. The cylindrical socket 26 is structured to receive therein an elongate screw 30, such that a distal portion 32 of the screw 30, which is generally half of the entire length of the screw 30, protrudes from the elongate cylindrical shaft portion 24 of the clamp member 20. Secured about the distal portion 32 of the screw 30, at a position substantially adjacent to the head portion 34 of the screw 30, is an O-ring 38. The O-ring 38 is made of rubber or a like high friction material.

As further detailed in FIG. 2, the weight means 40 includes a concentrically located transverse bore 42. The transverse bore 42 is divided into three separately diametered portions 44, 46, and 48. The proximal portion 44 of the bore 42, is of a diameter slightly larger than that of the elongate cylindrical shaft portion 24 of the clamp member 20, such that the weight means 40 may easily slide thereover. The center portion 46 of the transverse bore 42 is of a diameter slightly larger than that of the distal portion 32 of the elongate screw 30, thereby allowing the weight means 40 to slide thereover. Finally, the distal portion 48 of the transverse bore 42 is of such a diameter that it contacts the O-ring 38, thereby allowing the weight means 40 to slide only when desired.

Figure 3:
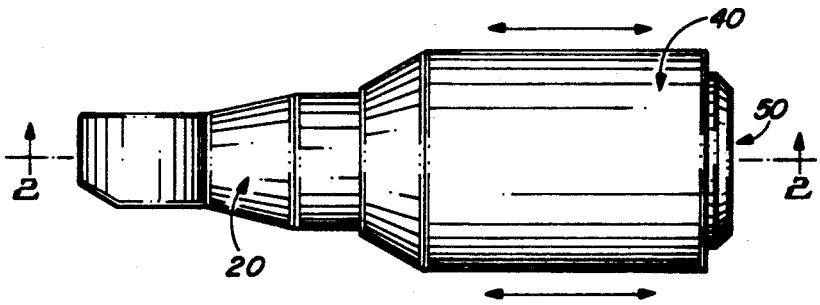
FIG. 3 is a side view of the force couple device.
Figure 4:
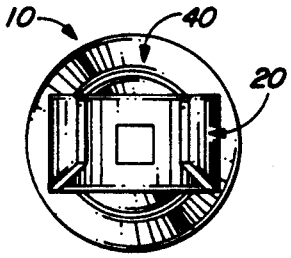
FIG. 4 is a front view of the force couple device.
Figure 5:
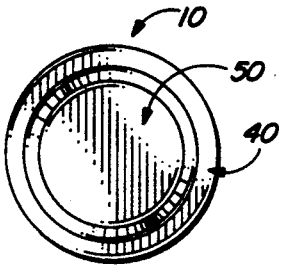
FIG. 5 is a rear view of the force couple device.
Figure 6:
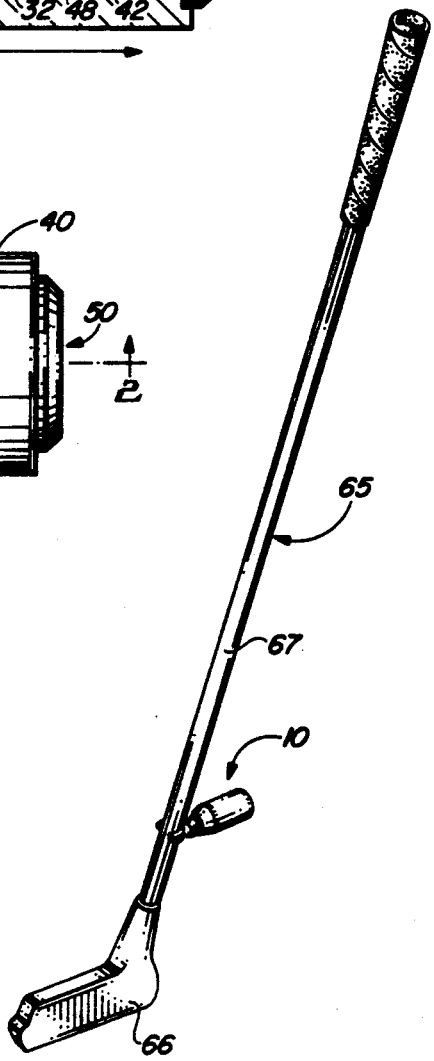
FIG. 6 is a perspective view of the force coupling device secured to a putter for use.

As detailed in FIGS. 3 through 5, the force couple device 10 includes a generally tapered shape to minimize added drag on the golf swing. Further, all parts are concentrically positioned to minimize the exterior diameter, and the device 10 also includes an end cap 50 to enclose the inner-portions thereof. As detailed in FIG. 6, the device 10 will be clamped near the head portion 66 on the shaft 67 of the golf club 65, as the head portion 66 is most subject to reorientation during a swing. Additionally, the couple device 10 could be positioned on the shaft of other sporting or industrial machines which are subject to a variety of counteractive resultant forces that if balanced by means of a couple would enable the machine to function more accurately and efficiently. Accordingly, these uses will prevent wear against adjacent parts and promote accuracy and fluid motion.

It should be noted that the particular structural features recited may be varied consistently with the theories and intent of the applicant, and in accordance with the doctrine of equivalents.

Now that the invention has been described, what is claimed is:

1. To be attached to a golf club; a device to couple forces acting on a club head of the golf club so as to properly orient and align a face of the club head when swinging, the device comprising:

a clamp member, including a rounded clamp portion and an elongate cylindrical shaft portion, said clamp member being made of a sufficiently elastic plastic or like material, such that said clamp portion may be securely fitted around the golf club shaft, said cylindrical shaft portion including a threaded, cylindrical socket, an elongate screw secured within said threaded, cylindrical socket, such that generally half of said screw protrudes from said clamp member, an O-ring, made of rubber or a like high friction material, being secured about said screw at a protruding distal end thereof, a generally cylindrical weight means including a concentrically located transverse bore, said bore at a proximal end of said weight means being of a diameter sufficient to slidably surround said shaft portion of said clamp member, said bore at a center portion of said weight means being of a diameter sufficient to allow a protruding shaft portion of said screw to slidably pass therethrough, yet being narrow enough such that said O-ring and a head portion of said screw may not slide therethrough, said bore at a distal end of said weight means being of a diameter such that said O-ring contacts said weight means, thereby requiring that a force be exerted on said means in order to adjust said weight means, and an end cap attached at said distal end of said weight means to cover said bore.

2. A device as recited in claim 1 wherein said elongate shaft portion includes indicia thereon.

3. A device as recited in claim 2 wherein said clamp portion is of a configuration sufficient to removably secure the apparatus about the shaft of the club.

4. A device as recited in claim 3 wherein said weight means is comprised of sufficiently heavy ferrous material.

5. A device as recited in claim 3 wherein said weight means is comprised of sufficiently heavy non-ferrous material.

* * * * *